US006001397A

United States Patent [19]

Boyd et al.

[11] Patent Number: 6,001,397

[45] **Date of Patent: *Dec. 14, 1999**

[54] METHOD FOR PACKAGING CHEWING GUM AND CHEWING GUM SO PACKAGED

[75] Inventors: William T. Boyd, Aurora; Stanley J. Kopecky, Prospect Heights; Patricia McCarren, Chicago; Michael Shulski, Northfield, all of Ill.

[73] Assignee: Wm. Wrigley Jr. Company, Chicago, Ill.

[ * ] Notice: This patent is subject to a terminal disclaimer.

[21] Appl. No.: 08/997,277

[22] Filed: Dec. 23, 1997

[51] Int. Cl.[6] ..... B65D 65/02

[52] U.S. Cl. ..... 426/5; 426/106; 426/123; 426/125; 426/410; 426/415; 53/455; 53/466

[58] Field of Search ..... 426/3, 5, 106, 426/108, 123, 125, 410, 415; 53/455, 466, 472

[56] References Cited

U.S. PATENT DOCUMENTS

| | | | |
|---|---|---|---|
| 1,216,259 | 2/1917 | Armstrong . | |
| 1,869,584 | 8/1932 | Reymond . | |
| 2,140,740 | 12/1938 | Giuntini | 33/3 |
| 2,140,748 | 12/1938 | Johanson . | |
| 2,192,472 | 3/1940 | Huston | 426/108 |
| 2,201,956 | 5/1940 | Little | 426/123 |
| 2,210,195 | 8/1940 | Baldwin | 426/108 X |
| 2,449,334 | 9/1948 | Smith | 53/461 |
| 3,616,991 | 11/1971 | Beck | 229/66 |
| 3,632,424 | 1/1972 | Graham . | |
| 3,671,479 | 6/1972 | Ottinger et al. . | |
| 4,070,851 | 1/1978 | Schoppee . | |
| 4,150,161 | 4/1979 | Rudolph et al. . | |
| 4,514,422 | 4/1985 | Yang et al. . | |
| 4,526,790 | 7/1985 | Samala . | |
| 4,666,079 | 5/1987 | Bolli et al. . | |
| 4,842,870 | 6/1989 | Dokuzovic et al. . | |
| 4,881,646 | 11/1989 | Weber . | |
| 4,993,213 | 2/1991 | Kobler et al. . | |
| 5,048,260 | 9/1991 | Raymond et al. . | |
| 5,215,249 | 6/1993 | Gorrieri . | |
| 5,376,388 | 12/1994 | Meyers . | |
| 5,479,761 | 1/1996 | Weder | 53/461 |
| 5,510,124 | 4/1996 | Kopecky et al. | 426/5 |
| 5,520,602 | 5/1996 | Jenkins | 493/128 |

*Primary Examiner*—Milton Cano
*Attorney, Agent, or Firm*—Hill & Simpson

[57] ABSTRACT

A wrapper for housing chewing gum. The wrapper includes a substrate having a front and a back surface. The front surface includes a top edge, a first side edge, a bottom edge, a second side edge, and three areas of adhesive. A first area of adhesive extends along a portion of the front surface that is adjacent to the first edge. A third area of adhesive extends along a portion of the front surface that is adjacent to the second side edge. And a second edge of adhesive extends between the first and third areas of adhesive of a portion of the front surface that is in juxtaposition to, but not touching, the bottom edge. A stick of chewing gum and method of wrapping the stick of chewing gum are also provided.

20 Claims, 1 Drawing Sheet

METHOD FOR PACKAGING CHEWING GUM AND CHEWING GUM SO PACKAGED

BACKGROUND OF THE INVENTION

The present invention generally relates to chewing gum. More specifically, the present invention relates to methods of wrapping and packaging chewing gum in individual units and units so wrapped.

Chewing gum, during storage or exposure to ambient conditions, has a tendency to loose or gain moisture from the surrounding atmosphere. This tendency can be dependent upon the ambient temperature, relative humidity, and the packaging used to house the chewing gum. The packaging of chewing gum is important in keeping the product clean and reducing the tendency of the chewing gum to lose and gain moisture. Additionally, to reduce the loss of flavor, reduce oxidation, and/or to prevent the product from picking up foreign aromas the packaging is important.

Various techniques have been developed for the purpose of protecting chewing gum from moisture loss, moisture gain, and other adverse changes which result from storage. For example, it is known to generally package pieces of chewing gum in a wrapper that comprises a composite material having a tissue or paper substrate that contacts the chewing gum. This wrapper may also have an outer metal/foil surface. A second paper wrapper is then placed around the first wrapper to secure the packaging. This second wrapper will typically display the gum type and company logo; but, in large or multi-stick packs this wrapper may be plain white.

Typically, these double wrapped sticks of chewing gum are then housed as a group of individually wrapped gum pieces in, for example, a package more commonly referred to in the industry as a counterband. A counterband is usually also a composite material, such as, an interlayer of aluminum foil with a paper and/or polypropylene outer surface. A counterband seals the individually wrapped pieces of chewing gum until opened by the consumer.

Typically, the wrapping process for chewing gum is accomplished using high-speed wrapping machines. These machines package (wrap), using the two wrapping process, the individual units of chewing gum. The double wrapped individual units can then be combined into a multi-unit package, again employing high speed wrapping machines.

The current double wrapping process does provide protection to the product, which is its major purpose. However, the double-wrapper has inherent disadvantages. The two wrapper process, doubles the amount of wrapping materials which is an environmental concern because it generates more waste. Additionally, the two wrapper process creates cost concerns because it doubles the requisite materials and the wrapping time required.

As an alternative to the two wrapper process, attempts at using a one wrapper process and system have been made. However, each of these designs has created some apparent issues. Some such designs are hard to open, require new machinery, and/or alter traditional appearance. Additionally, if not sealed properly, one wrapper does not provide adequate protection to the chewing gum.

There is therefore, a need for improved packaging that allows chewing gum to be wrapped in a single wrapper using a high speed wrapping process.

SUMMARY OF THE INVENTION

The present invention provides a method for providing packaged units of chewing gum and chewing gum so packaged. Pursuant to the present invention, chewing gum can be wrapped in a single wrapper that is properly sealed.

To this end, the present invention provides a wrapper for housing chewing gum. The wrapper includes a substrate having a front and a back surface. The front surface includes a top edge, a first side edge, a bottom edge, a second side edge, and three areas of adhesive. A first area of adhesive extends along a portion of the front surface that is adjacent the first side edge. A third area of adhesive extends along a portion of the front surface that is adjacent the second side edge. A second area of adhesive extends between the first and third areas of adhesive along a portion of the front surface that is in juxtaposition to, but not touching, the bottom edge.

In an embodiment of the present invention, the first and third areas of adhesive extend from the top edge to the bottom edge.

In an embodiment of the present invention, the first, second, and third adhesive areas define a substantially rectangular area that does not include adhesive on the front face for supporting a stick of chewing gum.

In an embodiment of the present invention, the adhesive is chosen from the group consisting of: acrylic; acrylic with latex; natural latex; synthetic adhesives; and latex rubber.

In an embodiment of the present invention, the substrate is constructed, at least in part, from paper.

In an embodiment of the present invention, the back surface is defined, at least in part, by a metal foil.

In an embodiment of the present invention, the back surface includes printing thereon.

In an embodiment of the present invention, the substrate is chosen from the group consisting of: paper; foil; polypropylene; polyethylene; nylon; cellophane; ethylenevinyl alcohol; and polyethylene terephthalate.

In an embodiment of the present invention, the wrapper includes a barrier layer including a material chosen from the group consisting of: aluminum; aluminum oxides; silicon dioxide; polyvinyldichloride; polyethylene; and wax.

In an embodiment of the present invention, the barrier layer is created by applying a barrier material to the substrate using a method chosen from the group consisting of: coating; lamination; extrusion; plasma coating; and vacuum deposition.

In a further embodiment, the present invention provides a wrapped stick of chewing gum. To this end, the invention provides a stick of chewing gum and a wrapper that surrounds the stick of chewing gum. The wrapper, prior to surrounding the chewing gum, has a front surface having a top edge, a first side edge, a bottom edge, and a second side edge and three areas of adhesive. The first area of adhesive extends along the front surface that is adjacent to the first side edge. A third area of adhesive extends along the front surface that is adjacent the second side edge. And a second area of adhesive extends between the first and second areas of adhesive on the front surface and divides the front face into two areas that do not include adhesive. The wrapper secures the stick of chewing gum within an enclosed area for housing the chewing gum when the stick of chewing gum is placed on the front face and the top edge of the front surface is folded toward the bottom edge and the bottom edge of the front surface is folded up toward the top edge.

In an embodiment of the present invention, the back face includes printing thereon.

In an embodiment of the present invention, the first and third areas of adhesive extend from the top edge to the bottom edge.

In an embodiment of the present invention, the adhesive is chosen from the group consisting of: acrylic with latex rubber, natural latex, acrylic, synthetic adhesives, and latex rubber.

In yet another embodiment, the present invention provides a method for wrapping chewing gum. The method comprises the steps of: placing a stick of chewing gum on a wrapper including a front surface having a top edge, a first side edge, a bottom edge, and a second side edge and three areas of adhesive, the first area of adhesive extending along a front surface that is adjacent the first side edge, the third area of adhesive extends along the front surface that is adjacent the second side edge, and the second area of adhesive extends between the first and third areas of adhesive on the front surface in juxtaposition to, but not touching the bottom edge; folding the top edge of the front surface toward the bottom edge of the front surface so that it extends over a stick of chewing gum; folding the bottom edge of the front surface toward the top edge of the front surface so that is overlaps the folded top edge enclosing the stick of chewing gum within the wrapper; folding a first edge over the wrapped stick of chewing gum; and folding a second edge over the wrapped stick of chewing gum.

An advantage to the present invention is that it provides an improved method for wrapping chewing gum.

Further, an advantage of the present invention is that it provides an improved wrapped chewing gum product.

Another advantage of the present invention is that it provides a method for wrapping chewing gum in a single wrapper utilizing a high speed wrapping machinery.

Furthermore, an advantage of the present invention is that it provides a wrapping process that decreases the amount of wrapping materials.

Moreover, an advantage of the present invention is that provides a one wrapper process that provides potential cost benefit.

Still, an advantage of the present invention is that it provides a one wrapper process that provides environmental benefits.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
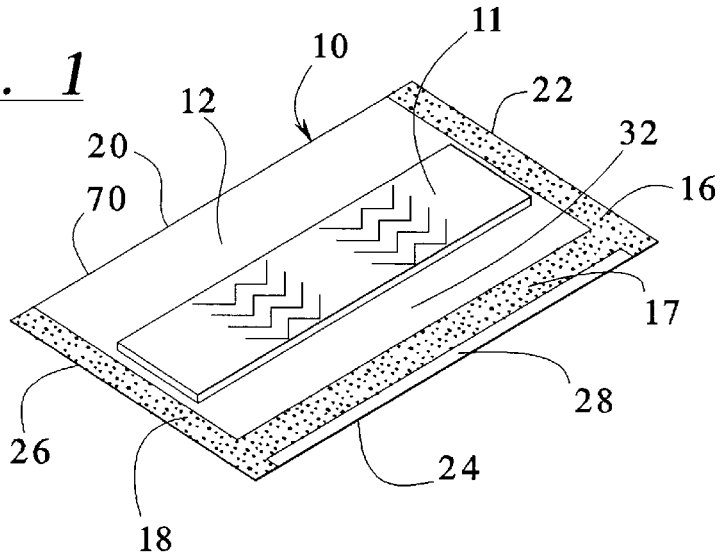
FIG. 1 illustrates a perspective view of an embodiment of the present invention during a step of the process for packaging a stick of chewing gum.

The present invention provides an improved method for packaging chewing gum products and products so packaged. Pursuant to the present invention, sticks of chewing gum can be provided to consumers in a single wrapper. Further, sticks of chewing gum can be wrapped with a single wrapper using a high speed wrapping machine.

To this end, the present invention provides an improved wrapping process which increases product protection and decreases materials and wrapping time. Additionally, the present invention increases machine efficiency, enables the wrapping of softer gum, and decreases waste.

Generally, as set forth in detail below, individual pieces of chewing gum, hereinafter refer to as "sticks", are wrapped in a single printed wrapper that has a weak adhesive applied on specific edges. This allows the wrapper to be sealed as much as possible around the stick of chewing gum at high speeds. The sealed wrapper improves product protection and still is easy to open. If desired, a foil or metal material can be used, and the printing can be done so that the finished stick of chewing gum resembles a traditional wrapped stick of chewing gum with metallic ends.

At the outset, it should be noted that although the present invention and preferred embodiment illustrated, is used with a stick of chewing gum having a rectangular shape, other chewing gum shapes can be used. Further, although the wrapper is illustrated, in its open condition, as having a substantially rectangular shape, other shapes of the wrapper can be used.

The wrapping of the stick of chewing gum in a single wrapper may be desirable to provide better protection for the product. Additionally, as is noted above, the use of a single wrapper reduces material costs and wrapping time. However, it is desirable to maintain the existing package size, printing, and aesthetic look of traditional wrappers.

Pursuant to the present invention, sticks of chewing gum can be wrapped in a single wrapper and be provided with a viable shelf life. This is true, even if the chewing gum is being shipped, stored, or sold in environments that are very detrimental to chewing gum; such as areas having a high or low humidity and/or high temperature.

The wrapper of the present invention can be comprised from a wide range of materials. The wrapper may consist of a single substrate or preferably includes a barrier material. A wide variety of substrates can be used. Suitable substrates include: paper; foil; polyfilm such as polypropylene (extruded, biaxially oriented, or cast); polyethylene (high or low density); nylon; cellophane; ethylenevinyl alcohol; and polyethylene terephthalate.

In an embodiment, a barrier material is applied to the substrate material. A number of high barrier wrapping materials can be used in the present invention to provide a vapor, oxygen, and flavor barrier for the gum. Suitable barrier materials include: aluminum; aluminum oxide; silicon dioxide; polyvinyldichloride; polyethylene; wax; and other materials that provide vapor and oxygen barrier characteristics to the substrate. Such barrier materials can be affixed to the substrates by a variety of methods. Such methods include: coating; lamination; extrusion; plasma coating; or vacuum deposition.

In a preferred embodiment, the wrappers are used to create blanks in which the chewing gum pieces are placed. Chewing gum pieces are then sealed within the blanks.

In this regard, referring now to the figures, an embodiment of the wrapper and seal technique of the present invention is illustrated in FIGS. 1–4. Pursuant to the method of the present invention, a wrapper 10 is provided. The wrapper 10 includes a front face 12 and a back face 14. The front face 12 includes three adhesive areas 16, 17, and 18. Any adhesive can be used that creates a seal that does not leave a substantial, if any, residue. Preferably, the seal is created by a weak pressure sensitive adhesive such as that used on "Post-It Notes" sold by 3M Commercial Office Supply of St. Paul, Minn. or heat a seal. Examples of suitable adhesives include: acrylic with latex rubber; natural latex; acrylic; synthetic adhesive; and latex rubber. Preferably the adhesive is applied to the front face 12 of the wrapper 10 when the wrapper is manufactured.

Generally, the wrapper 10, because in the preferred embodiment illustrated is rectangular, includes four side edges. These sides herein are referred to as the top edge 20, first side edge 22, second side edge 26 and bottom edge 24. However, the use of the terms top and bottom edge is merely a convenience, and does not mean that the edges can not be reversed, e.g. the bottom edge oriented on "top" when viewed.

In the embodiment of the wrapper 10 illustrated in FIG. 1, the three adhesive areas 16, 17 and 18 are oriented along, or in juxtaposition to the edges. In this regard, each of the first and second side edges has located there along an adhesive areas 16 and 18 respectively. In the preferred embodiment illustrated, these adhesive areas 16 and 18 extend along each of the side edges 22 and 26, respectively, from the top 20 to the bottom edge 24. It should be noted however, that the adhesive areas 16 and 18 do not need to extend all the way from the top edge 20 to bottom edge 24.

The width of the first and third adhesive areas 16 and 18 is chosen so as to insure that a stick of chewing gum 11 can be placed on the front face 12 of the wrapper 10 without contacting either the first or third adhesive areas. Thus, the width of the first and third adhesive area 16 and 18 can vary depending on the size and/or shape of the stick of chewing gum 11 to be wrapped.

As illustrated, the second adhesive area 17 is located in juxtaposition to the bottom edge 24 of the wrapper 10. In this regard, in the preferred embodiment illustrated, the second adhesive area 17 does not extend all the way to the bottom side edge 24. Instead, a portion 28 of the front face 12 of the wrapper does not include adhesive and extends below the second adhesive area 17. This area 28 defines a flap 30 when the stick of gum 11 is completely wrapped.

In the preferred embodiment illustrated, the second adhesive area 17 extends from the first adhesive area 16 to the third adhesive area 18. Similar to the first adhesive area 16 and third adhesive area 18, the second adhesive area 17 is located so as to allow a stick of chewing gum 11 to be placed on the front face 12 of the wrapper 10 without contacting any adhesive.

Figure 2:
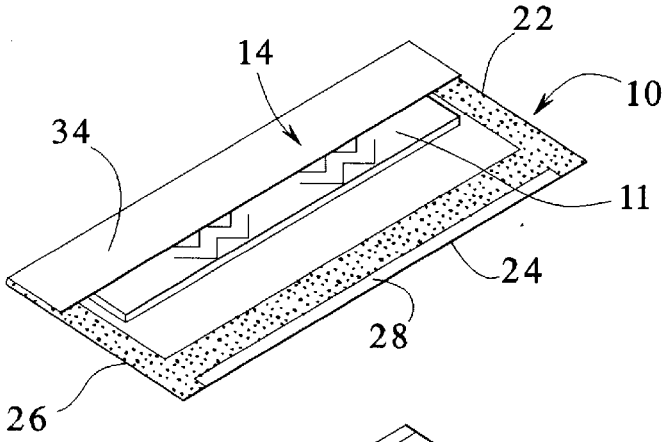
FIG. 2 illustrates a perspective view of a further step in the process for packaging the stick of chewing gum.

FIGS. 1–4, illustrated the method for wrapping a stick of gum 11 in the wrapper 10. First, the stick of gum 11 is located on a surface 32 of the front face 12 that does not include adhesive. As illustrated in FIG. 2, the wrapper 10 is folded so as to cause the top edge 20 to fold over at least a portion of the stick of chewing gum 11. Because the top edge 20 does not include adhesive, no adhesive contacts the chewing gum 11.

In the preferred embodiment illustrated, the top edge 20 folds over one-half of the width of the chewing gum 11. However, of course, the top edge 20 can fold over a greater or lesser extent of the width of the stick of chewing gum 11. What is important is that adhesive does not contact the stick of chewing gum 11.

Figure 3:
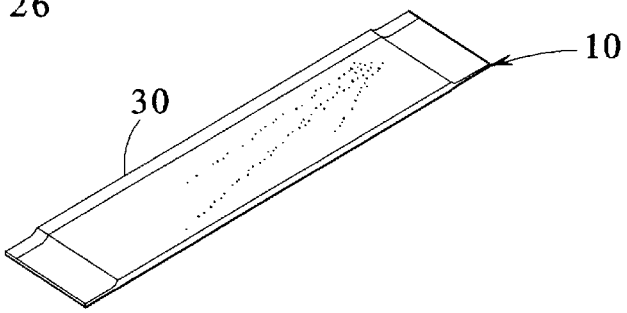
FIG. 3 illustrates a perspective view of a further step in the process for packaging the stick of chewing gum.

In the next step of the process, illustrated in FIG. 3, the bottom edge 24 is folded over so that the second area of adhesive 17 to contact a portion 34 of the back face 14 of the wrapper 10. This causes the second area of adhesive 17 to seal to this portion 34 of the back face of the wrapper 10. At this stage, the stick of chewing gum 11 is sealed within the wrapper 10.

Figure 4:
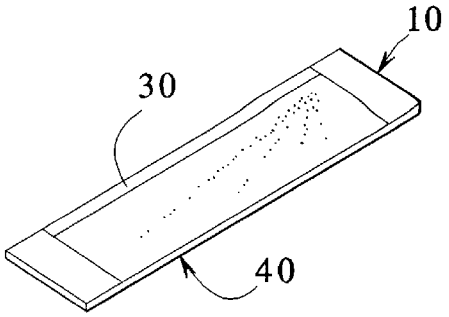
FIG. 4 illustrates a stick of chewing gum packaged pursuant to an embodiment of the present invention.

In the final stage of the process illustrated in FIG. 4, the second and second edges 22 and 26 are folded over to create a wrapped stick of chewing gum 40. This creates a sealed chewing gum product.

An advantage of the process is that the folding sequence of the wrapper 10 is similar to that currently used. Accordingly, the process can be carried out on high speed wrapping machines.

When so sealed, because the bottom edge does not include adhesive that extends to the bottom edge 24 portion 28, a lip or flap 30 is created in the sealed chewing gum wrapper 40. This flap 30 can be used by the consumer to open the wrapper to access the stick of chewing gum 11 contained therein.

The back face 14 of the wrapper 10 may have printing and/or color thereon which correlates with the product. This will allow individual sticks of product 40 to be sold. Or, if desired, the individual sticks of the product 40 can be combined with other sticks and sold as a multi-stick package.

Preferably the wrapper material provides some moisture and oxygen barrier properties. In this regard, in an embodiment preferably the wrapper provides a moisture vapor permeation rate of less than 0.1 g/100 $in^2$/day as measured by ASTM method F1249-90. In an embodiment, preferably, the material provides an oxygen permeability of less than 0.2 cc/100 $in^2$/day at one atmosphere according to ASTM method D3985-81.

A variety of chewing gum compositions can be packaged in the packaging and using the method of the present invention. A chewing gum composition generally includes a water soluble bulk portion, a water insoluble chewing gum base portion, and one or more flavoring agents. The water soluble portion dissipates over a period of time during chewing. The gum base portion is retained in the mouth throughout the chewing process.

The insoluble gum base generally includes elastomers, resins, fats, oils, waxes, softeners and inorganic fillers. The elastomers may include polyisobutylene, isobutylene-isoprene copolymer, styrene butadiene rubber and natural latexes such as chicle. The resins may include polyvinyl acetate and terpene resins. Low molecular weight polyvinyl acetate is a preferred resin. Fats and oils may include animal fats such as lard and tallow, vegetable oils such as soybean and cottonseed oils, hydrogenated and partially hydrogenated vegetable oils, and cocoa butter.

Commonly used waxes include petroleum waxes such as paraffin and microcrystalline wax, natural waxes such as beeswax, candelilla, carnauba and polyethylene wax. If desired, a wax free base composition can also be utilized. The present invention contemplates the use of any commercially acceptable chewing gum base.

The gum base typically also includes a filler component such as calcium carbonate, magnesium carbonate, talc, dicalcium phosphate and the like; softeners, including glycerol monostearate and glycerol triacetate; and optional ingredients such as antioxidants, colors and emulsifiers. The gum base constitutes between 5–95% by weight of the chewing gum composition, more typically 10–50% by weight of the chewing gum, and most commonly 20–30% by weight of the chewing gum.

The water soluble portion of the chewing gum may include softeners, bulk sweeteners, high intensity sweeteners, flavoring agents and combinations thereof. Softeners are added to the chewing gum in order to optimize the chewability and mouth feel of the gum. The softeners, which are also known as plasticizers or plasticizing agents, generally constitute between about 0.5%–15% by weight of the chewing gum. The softeners may include glycerin, lecithin, and combinations thereof. Aqueous sweetener solutions such as those containing sorbitol, hydrogenated starch hydrolysates, corn syrup and combinations thereof, may also be used as softeners and binding agents in chewing gum.

Bulk sweeteners constitute between 5–95% by weight of the chewing gum, more typically 20–80% by weight of the chewing gum and most commonly 30–60% by weight of the chewing gum. Bulk sweeteners may include both sugar and sugarless sweeteners and components. Sugar sweeteners may include saccharide containing components including, but not limited to, sucrose, dextrose, maltose, dextrin, dried invert sugar, fructose, levulose, galactose, corn syrup solids, and the like, alone or in combination. Sugarless sweeteners include components with sweetening characteristics but are devoid of the commonly known sugars. Sugarless sweeteners include, but are not limited to, sugar alcohols such as sorbitol, mannitol, xylitol, hydrogenated starch hydrolysates, maltitol, and the like, alone or in combination. Chewing gums of the present invention will use sugarless sweeteners exclusively or at least include same as a major portion of the bulk sweetener.

High intensity sweeteners may also be present and are commonly used with sugarless sweeteners. When used, high intensity sweeteners typically constitute between 0.001–5% by weight of the chewing gum, preferably between 0.01–1% by weight of the chewing gum. Typically, high intensity sweeteners are at least 20 times sweeter than sucrose. These may include, but are not limited to, sucralose, aspartame, salts of acesulfame, alitame, saccharin and its salts, cyclamic acid and its salts, glycyrrhizin, dihydrochalcones, thaumatin, monellin, and the like, alone or in combination.

Combinations of sugar and/or sugarless sweeteners may be used in chewing gum. The sweetener may also function in the chewing gum in whole or in part as a water soluble bulking agent. Additionally, the softener may provide additional sweetness such as with aqueous sugar or alditol solutions.

Flavor should generally be present in the chewing gum in an amount within the range of about 0.1–15% by weight of the chewing gum, preferably between about 0.25% by weight of the chewing gum, most preferably between about 0.5–3% by weight of the chewing gum. Flavoring agents may include essential oils, synthetic flavors or mixtures thereof including, but not limited to, oils derived from plants and fruits such as citrus oils, fruit essences, peppermint oil, spearmint oil, other mint oils, clove oil, oil of wintergreen, anise and the like. Artificial flavoring agents and components may also be used in the flavor ingredient of the invention. Natural and artificial flavoring agents may be combined in any sensorially acceptable fashion.

Optional ingredients such as colors, emulsifiers, pharmaceutical agents and additional flavoring agents may also be included in chewing gum.

Chewing gum is generally manufactured by sequentially adding the various chewing gum ingredients to any commercially available mixer known in the art. After the ingredients have been thoroughly mixed, the gum mass is discharged from the mixer and shaped into the desired form such as by rolling into sheets, scoring and cutting into pieces. Generally, the ingredients are mixed by first melting the gum base and adding it to the running mixer. The gum base may alternatively be melted in the mixer. Color and emulsifiers can be added at this time.

A softener such as glycerin can be added next along with syrup and part of the bulk portion. Further, parts of the bulk portion may then be added to the mixer. Flavoring agents are typically added with the final part of the bulk portion. The entire mixing process typically takes from five to fifteen minutes, although longer mixing times are sometimes required. Those skilled in the art will recognize that variations of this mixing procedure, or other mixing procedures, may be followed.

By way of example and not limitation, examples of the present invention will not be set forth.

EXAMPLE 1

A commercial production formula of peppermint sugar-free chewing gum was produced, sheeted, and cut to 2.85 inches in length, 0.75 inches in width and 0.067 inches in thickness. While fresh, several boxes were hand-wrapped using the method of the present invention illustrated in FIGS. 1–4. The wrapper was made from the following materials: oriented polypropylene/0.00028" Al foil/15# tissue paper.

A control was created using the same gum wrapped in the conventional method using a standard wrapper constructed from 0.00028" Al foil/15# tissue paper, and having the same size and dimensions as set forth above.

All of the gum was placed in a cabinet that was set to emulate severe conditions. The gum wrapped using the method of the present invention kept the peppermint sugar-free chewing gum acceptable to 11 days—a 175% improvement over the control which was only acceptable to four days. Acceptability was determined by sensory chewing by trained lab members.

EXAMPLE 2

A commercial production formula of a fruit sugar chewing gum was produced, sheeted, and cut to 2.85 inches in length, 0.75 inches in width and 0.067 inches in thickness. While fresh, several boxes were hand-wrapped using the method of the present invention illustrated in FIGS. 1–4 in the wrapper of the present invention described above in Example 1.

A control was created using the same gum wrapped in the conventional method.

All gum was placed in a cabinet that was set to emulate severe conditions. The fruit sugar chewing gum wrapped using the present invention lasted 7 days; a 75% improvement over the control which was unacceptable after four days. Acceptability was determined by sensory chewing by trained lab members.

It should be understood that various changes and modifications to the presently preferred embodiments described herein will be apparent to those skilled in the art. Such changes and modifications can be made without departing from the spirit and scope of the present invention without diminishing its attendant advantages. It is therefore intended that such changes and modifications be covered by the appended claims.

We claim:

1. A wrapper for housing chewing gum comprising:

a substrate having a front and a back surface;

the front surface including a top edge, a first side edge, a bottom edge, a second side edge, and three areas of adhesive; and a first area of adhesive extending along a portion of the front surface that is adjacent the first side edge, a third area of adhesive extending along a portion of the front surface that is adjacent the second side edge, and a second area of adhesive that extends between the first and third areas of adhesive on a portion of the front surface that is in juxtaposition to, but not touching, the bottom edge.

2. The wrapper of claim 1 wherein the first and third areas of adhesive extend from the top edge to the bottom edge.

3. The wrapper of claim 1 wherein the first, second, and third adhesive areas define a substantially rectangular area that does not include adhesive on the front face for supporting a stick of chewing gum.

4. The wrapper of claim 1 wherein the adhesive is chosen from the group consisting of: acrylic; acrylic with latex; natural latex; synthetic adhesives; and latex rubber.

5. The wrapper of claim 1 wherein the substrate is constructed, at least in part, from paper.

6. The wrapper of claim 1 wherein the back face is defined, at least in part, by a metal foil.

7. The wrapper of claim 1 wherein the back face includes printing thereon.

8. The wrapper of claim 1 wherein the a substrate is chosen from the group consisting of: paper; foil; polypropylene; polyethylene; nylon; cellophane; ethylenevinyl alcohol; and polyethylene terephthalate.

9. The wrapper of claim 1 wherein the wrapper includes a barrier layer including a material chosen from the group consisting of: aluminum; aluminum oxides; silicon dioxide; polyvinyldichloride; polyethylene; and wax.

10. The wrapper of claim 9 wherein the barrier layer is created by applying the material to the substrate using a method chosen from the group consisting of: coating; lamination; extrusion; vacuum deposition; and plasma coating.

11. A wrapped stick of chewing gum comprising:

a stick of chewing gum;

a wrapper that surrounds the stick of chewing gum, the wrapper prior to surrounding the chewing gum having a front surface having a top edge, a first side edge, a bottom edge, and a second side edge and three areas of adhesive, the first area of adhesive extending along a portion of the front surface that is adjacent to the first side edge, a third area of adhesive that extends along a portion of the front surface that is adjacent the second side edge, and a second area of adhesive that extends between the first and third areas of adhesive on the front surface and divides the front face into two areas that do not include adhesive; and the wrapper securing the stick of chewing gum within an enclosed area for housing the chewing gum when the stick of chewing gum is placed on the front face and the top edge of the front surface is folded toward the bottom edge and the bottom edge of the front surface is folded up toward the top edge.

12. The wrapped stick of chewing gum of claim 11 wherein the back face includes printing thereon.

13. The wrapped stick of chewing gum of claim 11 wherein the first and third areas of adhesive extend from the top edge to the bottom edge.

14. The wrapped stick of chewing gum of claim 11 wherein the adhesive is chosen from the group consisting of: acrylic; acrylic with latex; natural latex; synthetic adhesives; and latex rubber.

15. The wrapped stick of chewing gum of claim 11 wherein the wrapper includes a substrate chosen from the group consisting of: paper; foil; polypropylene; polyethylene; nylon; cellophane; ethylenevinyl alcohol; and polyethylene terephthalate.

16. The wrapped stick of chewing gum of claim 11 wherein the wrapper includes a barrier layer including a material chosen from the group consisting of: aluminum; aluminum oxides; silicon dioxide; and polyvinyldichloride.

17. The wrapped stick of chewing gum of claim 11 wherein the barrier layer is created by applying the material to the substrate using a method chosen from the group consisting of: coating; lamination; extrusion; and vacuum deposition.

18. A method for wrapping chewing gum comprising the steps of:

placing a stick of chewing gum on a wrapper including a front surface having a top edge, a first side edge, a bottom edge, and a second side edge and three areas of adhesive, the first area of adhesive extending along a front surface that is adjacent the first side edge, the third area of adhesive extends along the front surface that is adjacent the second side edge, and the second area of adhesive extends between the first and third areas of adhesive on the front surface in juxtaposition to, but not touching the bottom edge;

folding the top edge of the front surface toward the bottom edge of the front surface so that it extends over a stick of chewing gum;

folding the bottom edge of the front surface toward the top edge of the front surface so that it overlaps the folded top edge enclosing the stick of chewing gum within the wrapper and creates a wrapped stick of chewing gum having a top surface and a bottom surface;

folding a first edge over the top surface; and folding a second edge over the bottom surface.

19. The method of claim 18 wherein the wrapped stick of chewing gum includes printing on at least one of the top surface or the bottom surface.

20. The method of claim 18 wherein the wrapper includes a barrier layer.

* * * * *